US006250509B1

(12) United States Patent
Fuchs

(10) Patent No.: US 6,250,509 B1
(45) Date of Patent: Jun. 26, 2001

(54) MEDIA DISPENSER

(75) Inventor: Karl-Heinz Fuchs, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/388,517

(22) Filed: Sep. 2, 1999

(30) Foreign Application Priority Data

Sep. 7, 1998 (DE) ..... 198 40 721

(51) Int. Cl.[7] ..... B65D 88/54
(52) U.S. Cl. ..... 222/321.6; 222/380
(58) Field of Search ..... 222/321.1, 321.2, 222/321.6, 321.7, 380, 420, 422

(56) References Cited

U.S. PATENT DOCUMENTS

| | | | | |
|---|---|---|---|---|
| 3,107,035 | | 10/1963 | Cholet | 222/213 |
| 4,402,432 | * | 9/1983 | Corsette | 222/321 |
| 4,757,922 | * | 7/1988 | Landecker | 222/321 |

FOREIGN PATENT DOCUMENTS

| | | |
|---|---|---|
| 42 10 225 A1 | 3/1992 | (DE) . |
| 196 27 228 A1 | 7/1996 | (DE) . |
| 0 749 909 A2 | 12/1996 | (EP) . |
| 0 800 869 A1 | 10/1997 | (EP) . |

* cited by examiner

*Primary Examiner*—Kevin Shaver
*Assistant Examiner*—Thach H Bui
(74) *Attorney, Agent, or Firm*—Quarles & Brady LLP

(57) ABSTRACT

The dispenser orifice (13) may be closed off microbiologically tight by a valve plug (25) closing contrary to the direction of flow (11) and is opened against a spring (34) in the direction of flow (11). The medium gains access to the orifice (13) via throttling elements (22, 21, 49) so that it creeps practically non-pressurized to the attaching surface area (51) of a droplet former (50) where it accumulates into a droplet suspending in the upside-down position, as a result of which the medium contained in the dispenser (1) may be protected from germ contamination and the droplet may be simply administered to an eye or the like. Instead of being formed by a plunger pump (9) the delivery and compression chamber (15) may also be formed by a tube.

36 Claims, 3 Drawing Sheets

MEDIA DISPENSER

TECHNICAL FIELD AND BACKGROUND OF THE INVENTION

The invention relates to a dispenser with which flowable media may be released or discharged by pressurizing. Particulary liquid media, but also pasty, powdery and/or gaseous media are suitable. The dispenser is held and actuated single-handedly. The dispenser is primarily made by injection molding or of plastics. The medium may be discharged atomized, or delivered in discrete clusters or droplets having a volume of at least 5 or 15 $\mu$l and at the most 40 or 25 $\mu$l. The medium contains medicinal active substances for eye treatment, or the like.

Dispensers need to be microbiologically sealed to prevent the medium stored therein from being contaminated by germs gaining access from without. The medium needs to be protected from such detrimental effects during a long shelf life not only prior to first-time use (priming) of the dispenser but also after the initial or any following medium discharge. The dispenser may be for a single discharge of a medium dose in which its actuator is moved in one direction only up to the dispenser being totally emptied with no return or suction stroke being necessary. The total supply of the medium may be contained in a single delivery chamber, without any additional medium reservoir. The volume in the chamber is then variable for pressurized delivery of the medium. The dispenser or its actuator may also operate in two opposite direction via a working stroke for pressurized delivery directly followed by a return stroke for sucking a further medium dose into the delivery chamber. After discharge of a medium dose the microbiological seal is always able to be reproduced until the next discharge, which is not always necessary in the case of a disposable dispenser.

For this seal either a single valve or several valves may be suitable. The valves closing gaps are located in sequence in the flow direction in the outlet duct. The last or downstream valve is located as near as possible to the medium outlet or its opening bounds as formed by the transition between an inner circumference and an end face transversely adjoining this circumference. At this transition the medium detaches from all inner circumferences or internal dispenser faces for release to the environment. The medium may then still be guided downstream of the transition by accessible external dispenses faces.

OBJECTS OF THE INVENTION

An object is to provide a dispenser which avoids the drawbacks of known configurations and achieves advantageous effects of the aforementioned kind. Another object is to ensure a repeated microbiological seal against ingress of germs trough the bounds of the medium outlet or of inflow openings. A still further object is to provide for simple handling or for uncomplicated construction. An object is also to provide the dispenser for modular composition permitting adaptation to media differing in flowability.

SUMMARY OF THE INVENTION

The dispenser has a valve closing with high areal pressure. The valves closing gap may also form the cited bounds of the medium outlet. Thus the closing gap extends up to the outA ermost possible location of the outlet duct where the medium emerges on discharge as described. This location is a microbiological seal when the valve is closed. Thus, at the most, germs are able to collect on the permanently freely accessible outside of the dispenser but not gain access upstream past the tight closing gap to internal faces of the dispenser.

The closing force is not reduced until the medium pressure in the outlet duet has attained at least 0.7 or 1 or 1.4 bar. The valve could be opened by purely mechanical actuation independently of the medium pressure. The cited sealing effect and preventing germ ingress with the valve open may also be improved by keeping valve travel as small as possible. The maximum relative travel of the two valve elements for opening or closing is less than 2 mm, 1 mm, 0.7 mm or 0.4 mm, e.g. 0.3 mm. On droplet discharge the medium then emerges practically with zero pressure or in a capillary creeping action through the valve gap. Upstream thereof it is the cited higher pressure of the medium that maintains the valve open. Thus the emerging and the opening medium fractions communicate within the outlet duct. Further upstream, means such as a pump for generating a medium pressure higher than the aforementioned pressures, i.e. two to five times higher may be provided, the medium pressure amounting to e.g. at least 4, 6 or 7 bar.

With this pressure the valve may be kept open. When a pressure substantially lower as compared thereto is generated in the conveying chamber, for instance maximally or less than two or one bar, then for opening the final valve it is of advantage to provide means for transforming the force by a transmission ratio between the conveying chamber and the control member which opens the final valve. Therefor the opening pressure acts on correspondingly large faces areas of the control member. Compared thereto the faces on which the medium pressure acts in the closing direction are substantially smaller.

To nevertheless attain a discharge of the medium at the medium outlet at a pressure which as compared to the above is reduced or pressureless, a throttling gap is provided down-stream of the medium fractions which open the valve. The passage cross-section of the throttling gap is substantially smaller than that of the opened valve and may be varied as a function of the medium pressure. For example, the opened passage cross-section of the valve may be at least 2, 40 or 50 times more than the throttling cross-section.

Upstream of the final valve a further valve may be provided, featuring the throttles properties. This valve too, closes microbiologically sealed, directly upstream of the medium outlet by radial pressure. The closing faces of the throttling valve are located in the region of the nozzle duct forming the medium outlet or therein. One of these closing faces may be integral with one of the closing faces of the closing gap at the medium outlet. Thus the same valve body may form a movable or openable closing face of the valve and a stationary closing face for opening the other valve, for example with the final valve open.

At least one further throttle or valve is located upstream of the above valves in the outlet duct. For example the medium fraction serving to open the valve is already pre-throttled in permanently constant throttling cross-sections while flowing on toward the throttle or the final valve. The medium is also throttled at the output or transition from the conveying chamber into the outlet duct or shut off microbiologically sealed at this transition. For this purpose a spring-loaded outlet or pressure relief valve is suitable. For forming the closing gap the closing faces of each of the valves may have only linear contact or maximum closing pressure along a sole annular line, thus resulting in maximum specific areal pressures. One of the closing faces is thus bounded in each case as a sharp edge by two angularly interconnecting flanks or by a spherical face.

The medium is manually conveyed by a thrust piston pump or a flexible squeeze container, such as a tube. In the second case the complete valve control of the dispenser is arranged in the constricted tube tip which is in one part with the tube shell. In case of a piston pump the pump cylinder or pump piston thereof is included in the pump stroke motion commonly with the medium outlet. This motion is directed counter the opening direction of the movable valve body.

A droplet former is provided with which the medium, particularly in the upside-down position of the dispenser with the medium outlet oriented downwards, accumulates into an exposed droplet of a metered volume. The droplet then hangs at a diameter suspended on the dispenser, which diameter is smaller than the largest drop diameter. Thus the drop does not detach until its lower end face comes into contact with a counter face, such as the eyeball. The droplet thus not commences to flow onto the counter face until this contact is made. The droplet accumulator or droplet former has a convex and/or concave attaching face for the droplet. This face may be spherical or smooth or polygonal to increase the areal size at a same base areal extension. This face directly adjoins the closing faces of the final valve and is formed by the end of a needle traversing the medium outlet.

BRIEF DESCRIPTION OF THE DRAWINGS

Example embodiments of the invention are explained in more detail in the following and illustrated in the drawings in which.

DETAILED DESCRIPTION

Figure 1:
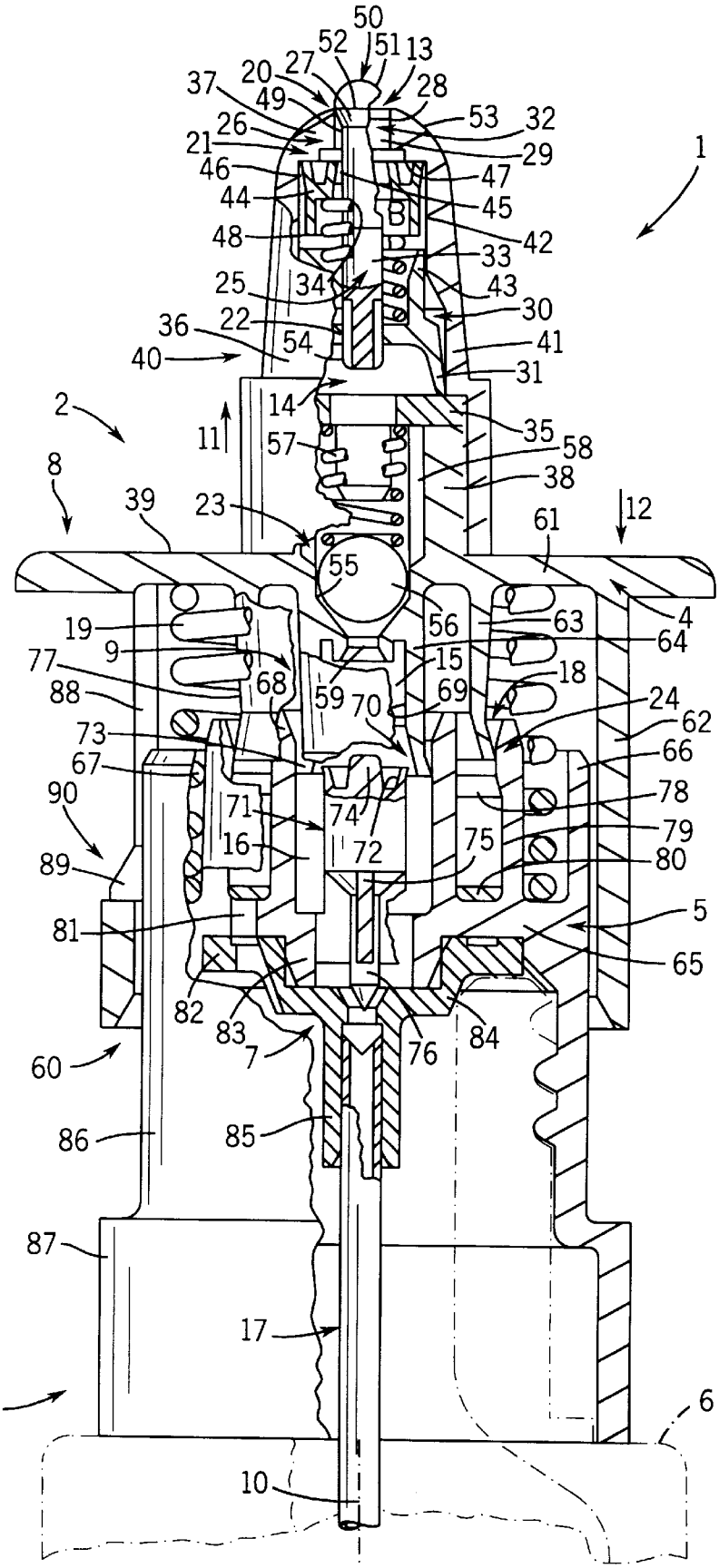
FIG. 1 is a side view of the dispender partially in cross-section and in the rest position.

FIG. 1 illustrates the dispenser 1 comprising two units 2, 3 with integral base bodies 4, 5, the mutual displacement of which results in shortening and elongating the dispenser 1. Supporting body 5 is sealingly secured by a flange 7 to the bottleneck of a reservoir 6, for example a bottle of glass or the like. Units 2, 4 and 3, 5 form a pump 9 with a manual actuator 8. All parts are located in axis 10. On discharge, the medium flows parallel to axis 10 in direction 11 from unit 3 through unit 2 out of medium outlet 13 thereof. Unit 2 is thereby displaced commonly with outlet 13 in the opposite direction 12 and relative to unit 3.

Outlet 13 may be oriented at right angles or transverse to axis 10 and is formed by the end of an outlet duct 14 traversing unit 2 only. The upstream end of duct 14 is directly connected to a conveying chamber 15 which is volumentrically variably bounded by two bodies 4, 5. Upstream chamber 15 adjoins valveless a pre- or priming chamber 16 supplied valveless with medium via a riser duct 17 from the bottom of reservoir 6. Corresponding to its emptying reservoir 6 receives a flow of atmospheric air from without on each working stroke via a venting means 18 which are bounded by bodies 4, 5. The return stroke of units 2, 3 into the dispensers longer initial or rest position is powered by a spring 19 or a permanently pretensioned helical compression spring directly supporting on bodies 4, 5.

In flowing from chamber 15 up to and out of outlet 13 the medium is controlled by a sequence of separate valves 20 to 23 located in this numerical and actual sequence from the vicinity of outlet 13 upstream up to the end of chamber 15. Each valve forms a separate length section of duct 14. Vent 18 is controlled via valve 24. Valve 20 has two separate and internested valve bodies 25, 26 each in one part. The closing faces 27, 28 of bodies 25, 26 bound outlet 13. At outlet 13 the medium detaches from the dispenser 1 into the environment or it remains attached to only one one-part and freely accessible outer face of the dispenser 1. The outer, annular closing face or valve seat 28 is conically widened in direction 11 and forms the end of an integrally bounded nozzle bore or duct 29 of unit 2. The inner complementary annular or conical closing face 27 is formed by pin-shaped body 25 which is moved in direction 11 by control means 30 for opening the valve when a correspondingly high medium pressure has been attained in chamber 15, when valve 23 has opened and when the pressure has reached the downstream adjoining portion of duct 14.

Control 30 includes a piston 31 with a piston lip conically widened in direction 12 and freely protruding from a piston crown. Fixedly anchored in the crown is the upstream end of body 25. Duct 14 and the rotationally symmetrical stem 33 of body 25 traverse the crown where they commonly bound duct 14. At the downstream end of body 25 the stem 33 has a widened head 32 which forms face 27 directly connecting to the outer circumference of stem 33. Body 25 is loaded in the closed position by a permanently pretensioned spring 34 directly adjoining downstream the crown and surrounding only stem 33 as a helical compression spring within duct 14. In the rest position body 25 is locked by an annular disk-shaped stop 35 which is in contact with the end of piston lip 31 and bounds duct 14 by its inner circumference.

Cap-shaped valve body 26 has a shell 36 which as compared to its outer diameter is up to twice as long. Shell 36 is integrally translated into end wall 37. Wall 37 is traversed by duct 29 and outlet 13. The end of shell 36 is step-wise widened in direction 12. In this end a sleeve-shaped lug 38 of body 4 engages in direction 11. Between the lugs end face and an annular inner shoulder stop 35 is fixed. Shell 36 extends up to a handle 39 of actuator 8.

Body 26 of unit 2 forms in axis 10 or parallel thereto a nozzle-type discharge head 40 continually tapered in direction 11 up to its end and also suitable for being introduced into a bodily opening such as a nostril. The inner circumference of shell 36 forms up to stop 35 a sealing contact face 41 for piston 31. The pistons inner circumference bounds 14. Downstream thereof the same inner circumference forms a more constricted running face 42 for a likewise annular piston 43. This pistons lip freely protrudes in direction 11 from the crown of piston 31. Piston 43 also bounds duct 14 by its inner circumference. Provided between the duct sections bounded by pistons 31, 43 is the throttle 22. The piston area of 31 which is effective in direction 11 is substantially larger than that of plunger 43 and acting in the opposite direction. Between the one-part lips of pistons 31, 43 their outer circumference adjoins an annular dry space which is permanently without contact with the medium.

Provided an annular piston or throttling body 44 downstream directly adjoins unit 31, 43 and is located in sleeve 36 and about stem 33. Body 44 has a lip 45 freely protruding from the inner circumference of a crown in direction 11. This lip sealingly contacts the outer circumference of stem 33 with radial pressure. A further lip 46 protrudes from the same crown and the outer circumference thereof in direction 11 about lip 45 and to the same extent. Lip 46 contacts with radial pressure the inner circumference of shell 36 and the inner face 47 of wall 26. A sleeve-shaped stop 48 for piston 43 protrudes in the direction 12 from the same plunger crown. Spring 34 directly adjoins the two crowns of pistons 31, 33, 44 and is surrounded by sleeves 43, 48. Lip 45 is radially spacedly surrounded, by lip 46, while being not in contact with stop 47 due to widening of duct 29. Lip 45 is acutely conically constricted in direction 11. Its radial results in a motion vector for medium in direction 11. Between stem 33 and lip 45, on the one hand, and the inner circumference of duct 29, on the other, an annular gap 49 of duct 14 is bounded in each case. This gap is sealed off, on the one hand, at lip 45 and, on the other, at faces 27, 28. Spring 34 permanently urges face 27 in direction 12 against seat 28 with no self-locking effect. With valve 20 closed nozzle duct 49 is also bounded by part of face 27 due to it being longer than seat 28.

Provided permanently freely accessible on the outside of the dispenser 1 and communicating with outlet 13 is a protuberance or droplet former 50 formed by head 32 and, where necessary, the adjoining parts of the bulging end face 53 of wall 26. The exposed end face 51 of head 32 is curved spherically or hemispherically, it directly adjoining by a ring edge 52 the widest portion of face 27. When valve 20 is closed edge 52 directly adjoins the outside 53 of wall 37 or the ring edge of seat 28 flanked by the latter. This ring edge bounds outlet 13 and is acutely flanked in axial cross-section, whereas edge 52 is obtusely flanked.

Provided permanently communicating in the region of the crown of piston 31, 43 are throttling ducts 54 of the throttle 22 in the form of longitudinal grooves in the outer circumference of stem 33. The full passage cross-section of ducts 54 is substantially smaller than that from chamber 15 up to piston 31, from piston 43 up to piston 44 and adjoining downstream lip 45. It is, however, greater than that which exists at lip 45, when throttle valve 21 is open, and between faces 27, 28, when valve 20 is open.

Outlet valve 23 of pump chamber 15 has an actutely angled conical valve seat 55 of body 4 and a ball 56 of plastics, metal or the like having a spherical counter face. Valve body 56 is loaded in direction 12 by a permanently pretensioned spring 57 against annular or linear contact with valve body 55. The helical compression spring 57 is in direct contact with bodies 35, 56, it being center-located in direction 12 on a freely protruding finger of sealing body 35. The finger defines the opening travel of body 56 by a stopping action. From valve 23 up to body 35 the duct 14 is bounded constant in width by stop 38, the inner circumference of which is provided with longitudinal or control grooves which are spaced from the valve seat in direction 11. Over a first opening travel of body 56 only a very small passage cross-section is opened, whereas over the subsequent opening travel up to the stop on body 35 the largest circumference of body 56 is in the region of the ducts 58, thus opening up a correspondingly larger passage cross-section which is also larger than that of throttle 22. Upstream adjoining the closing seat of valve 23 is a valve inlet 59 which is more constricted as compared to the latter and to chamber 15. This valve inlet is formed by an appendage of body 4 freely protruding in direction 12 into chamber 15.

Bodies 4, 5 form a housing 60 extending from an end wall 61 in direction 12 up to the upstream end of body 5. Freely protruding beyond wall 61 of the latter in direction 11 is only body 26 or head 40, the outer faces of which are freely accessible. An end face of wall 61 forms handle 39. Beyond the other end face the shells 62 to 64 of body 4 protrude only in direction 12. These shells are commonly in one part. Appendage 38 protrudes only beyond the face 39. Body 5 comprises likewise with a spacing between its ends an end wall 65 permanently located within body 4 and shells 66 to 68 freely protruding in direction 11 and commonly in one part. Outermost and longest shell 62 permanently surrounds all remaining walls 63 to 68 and may be set back radially relative to the outer circumference of wall 61 to adjoin this outer circumference. Shell 63 next in sequence or middle shell located radially spaced within shell 62 is directly opposes by its outer circumference the inner circumference of shell 67 at which it adjoins sealingly by an end lip in the rest position.

Shells 66, 67 are located permanently between shells 62, 63. Innermost shell 64 located radially spaced within shell 63 is located within inner shell 68, from which shell 67 has the same radial spacing as from shell 66. The upstream free ends of shells 63, 64 each form an annular piston lip widened at an acute angle in direction 12. The inner circumference of shell 64 bounds chamber 15 with a cylindrical cylinder 69, the upstream end of which is conically widened at an acute angle in direction 12 to form a closing face of an inlet valve 70. Within shell 68 a piston 71 of body 5 freely protrudes from wall 65 permanently into shell 64 and comprises at the downstream end an annular lip 72 forming a valve body of valve 70. In the rest position face 69 and lip 72 bound an annular inlet gap which is tightly closed after a first smaller stroke travel by lip 72 coming into contact with the slanting end of face 69. Adjoining this annular gap upstream is an annular priming chamber 16 bounded by protuberances 68, 71 and end lip 73 of shell 64 since this lip slides permanently sealed on the inner circumference of shell 68.

Radially spaced away within lip 72 the piston 71 comprises a protuberance or finger 74 sealingly or communicatingly engaging inlet 59 at the end of the pump stroke to unseat valve body 56 from seat 55 mechanically only as far as necessary to cause the valve to communicate without attaining its maximum passage cross-section. The protuberance of inlet 59 then engages the annular groove between protuberances 72, 74 and lip 72 comes into contact with the bottom of the annular groove about the protuberance. Adjoining the upstream conically tapered end of piston 71 are connecting members, such as ribs 75 of body 5. Ribs 75 extend from the conical intermediate section of piston 71 and from within chamber 16 upstream only over part of the thickness of wall 65 as well as of the length of a slimmer finger 76 of piston 71. Thus annular wall 65 is traversed in the center by an annular passage subdivided by ribs 75 circumferentially. At the end of the pump stroke the lip 73 is able to stop against the bottom of chamber 16 or against wall 65 and to receive the sections of parts 75, 76 protruding therebeyond.

The conically widened end lip 77 of shell 63 is set back from piston lip 73 in direction 11 and slides after a first short partial stroke of the working stroke over a control face or step 78 of the inner circumference of shell 67. Thus valve 24 is opened on closing of valve 70. Shells 67, 68 bound in conjunction with shells 63, 64 an annular chamber 79. It is into this chamber that air is able to flow or be drawn in from its inflow between shells 62, 66, 63, 67.

Bottom 65 of chamber 79 is traversed by a communicating duet 81 which is totally covered by a filter 80 annular about axis 10 in chamber 79. Disk-shaped filter 80 is radially urged in contact with shells 67, 68 as well as with bottom 65 and may be attained or dislodged by valve element 73 at the stroke end. Spring 19 surrounds parts 63, 64, 67, 68, 80 it being located in the annular chamber directly between shells 62, 63, 66, 67 and directly supported on walls 61, 65.

Flange 7 forms an annular disk-shaped seal 82 engaging at the end face of wall 65 facing away from member 80 the annular gap thereof with zero radial clearance or the outer and inner circumference with radial pressure. Member 82 has at its downstream end side an annular groove bounding with wall 65 an annular duct traversing axis 10 and adjoining the communicating duct 81. Adjoining the inner circumference of seal 82 is a cap 84 of the one part flange 7 protruding in direction 12. Cap 84 is engaged by a sleeve-shaped appendage 83 of body 5 protruding from wall 65. Adjoining the bottom of the annular groove in line with the communicating duct 81 is a further communicating duct traversing seal 82 and continued as an inclined groove in the outer circumference of shell of cap 84. The free end of finger 76 protruding beyond ribs 75 in direction 12 is conically or pointed tapered, it engaging with radial spacing therefrom a conical hole in the bottom of cap 84 to thus define an annular inlet opening widened in the shape of a hollow cone in direction 11, the communicating cross-sections of which are substantially smaller than those in the region of ribs 75 or of chambers 15, 16. Protruding from the end wall of cap 84 solely in direction 12 is a mount, such as a sleeve 85 of flange 7 into which the riser tube is inserted .

Together with wall 65 and upstream thereof body 5 forms a cap or connector 86 for engaging the reservoir neck, the annular end surface area and the annular opening edge of which is set back from the latter adjoins with axial or radial pressure the seal 82 and outer circumference of cap 84 and are respectively firmly seated. The inner circumference of cap 86 is provided with a fastener or tensioning member, such as a thread, engaging a corresponding counter member on the outer circumference of the reservoir neck. The end of shell 86, 87 comes up against an annular shoulder of reservoir 6, this shoulder being formed by the transition between the barrel and neck of reservoir 6. At the end of the pump stroke body 4 does not come into contact with the annular shoulder of shell 87 by shell 62.

Units 2, 3 and bodies 4, 5 are positionally locked by a captive anti-twist lock 90. Provided in shell 62 is a slot 88 adjoining wall 61. The end of this slot is offset in direction 11 relative to the free end of shell 62 and in which a cam 89 engages at the outer circumference of shell 66. In the rest position the radially freely protruding cam 89 comes up against the end of the slot in the plane of the downstream end face of wall 65. Body 4 is mounted on body 5 in direction 12, the cam 89 springingly widening shell 62 by an inclined face until cam 89 snaps into place in slot 88, namely after walls 62 to 69 have clasped each other to interengage. Bodies 35, 56, 57 are inserted in body 4 in direction 12. Also body 40 is mounted in direction 12 on body 4. Bodies 31, 34, 44 are previously inserted in body 40 in direction 11. Either before or thereafter body 25 is inserted into bodies 4, 40 in direction 12 and the fixed connection made to piston 31, 43. The free end of shell 63 is set back relative to the free ends of shells 62, 64. The free end 73 of shell 64 is set back relative to that of shell 62. The free ends of shells 66, 67 are set back relative to that of shell 68. Shell 66 is set back relative to shell 67. Relative to the free ends of shells 66 to 68 the piston 71 is set back. Body 56 is located in the plane of wall 61. Bodies 25, 31, 41, 43, 44 are located totally outside of body 4 and in direction 11 are permanently spaced from body 4.

For the pump and working stroke handle 39 is squeezed by two fingers on both sides of head 40 and unit 2 displaced relative to unit 3 in direction 12 against spring 19. After a stroke of less than a millimeter inlet valve 70 closes, chambers 15, 16 thereby being totally filled with medium. Immediately thereafter valve 24 opens and any vacuum in reservoir 6 is compensated. In the further stroke the pressure increases in chamber 15 until the cracking pressure of valve 23 or body 56 is attained by cam 74 prior to the end of the working stroke, resulting in body 56 opening in direction 11 at seat 55 against the force of spring 57 either with the cited smaller passage cross-section or subsequently with the passage cross-section of duct 58. The medium thus gains access by the pressure in chamber 15 to duct 14 through body 35 into the dished recess of piston 31. Piston 31 is moved by this pressure against spring 34 together with body 25 in direction 11 until lip 43 comes up against lip 48. At the same time the medium flows from the piston dish 31 damped by the throttle 22 with increased flow velocity into the, in turn significantly widened piston 43, 48 where calming and deceleration of the flow occurs. The opening stroke of parts 25, 31, 43 amounts to but 0.3 mm for a maximum diameter of the opening 13, 28 of 5 mm, 4 mm or 2 mm.

From the calming chamber the medium flows directly against the inner circumference of lip 45. Lip 45 is unseated radially by the pressure of the medium from the cylindrical portion of stem 33 by a lift of maximally three or two tenths of a millimeter which is at least 10 or 20 times smaller than the axial stroke of the closing face 28, e.g. between 0.005 and 0.01 mm. The cracking pressure of valve 20 is with 1.5 bar at least half of the pressure in chamber 15 which may be in the range 7 bar to 8 bar. At the output of valve 21 the medium again gains access to a widened calming space bounded between lips 45, 56 and the upstream end of duct 29 and stem 33. From here the medium flows very slowly along stem 33 in duct 49 between the separate faces 27, 28, it creeping over edge 52 onto the face 51 where it accumulates into a droplet of 20 $\mu$l attaching thereto. In the upside-down position of the dispenser 1 and in all valve positions this droplet is then freely suspended from face 51. Piston 44 is permanently stationary relative to housing 36, 37. The calming chamber between pistons 43, 44 is variable in volume, it varying with the lift of valve 20.

Once the pressure drops in chamber 15 at the end of the stroke of pump 9, spring 57 closes valve 23 which may first close the communicating ports of ducts 58 and bound the more restricted passage cross-section before then sealing at seat 55 to thus permit a subsequent flow of the medium from chamber 15 into duct 14. At the same time as each of the cited closing actions of valve 23 and depending on the calibration the valve 20 closes before or thereafter, spring 34 thereby seating valve body 25 over the cited stroke in seat 28. Likewise at the same time as each of the cited closing actions and depending on the calibration valve 21 also closes before or thereafter. Accordingly the space between the closing face 28 and lip 45 remains either totally filled with medium or it is emptied at least in part. From lip 45 to seat 55 the duct 14 always remains after first-time use (priming) totally filled with medium, however. When valve 20 is closed, first piston 43 unseats from stop 48 defining the cited stroke flexibly or rigidly. At the end of the return stroke spring 19 opens valve 70 to cause the medium suctioned into chamber 16 on the return stroke by piston 73 to abruptly flow into the evacuated chamber 15. At the same time medium is subsequently suctioned through conduit 17 into chamber 16. The medium thereby flows about parts 76, 75, 71. In the rest position chambers 15, 16 are permanently in communication due to valve 70 being open. Shortly before the end of the return stroke, valve 24 of chamber 79 also closes, from which air has flowed through flange 7 into reservoir 6 whereby any germs in the air are killed in filter 80.

Conduit 17 and appendage 85 may also be eliminated, the pump 9 then priming medium from reservoir 6 through flange 7 only in the upside-down position, since it is in this position that the medium flows by the force of gravity up to and into chambers 15, 16.

Figure 2:
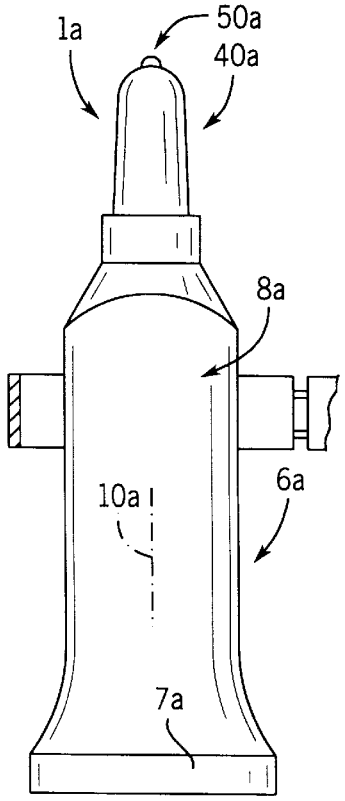
FIG. 2 is a view of a further dispenser illustrated in actual size.
Figure 3:
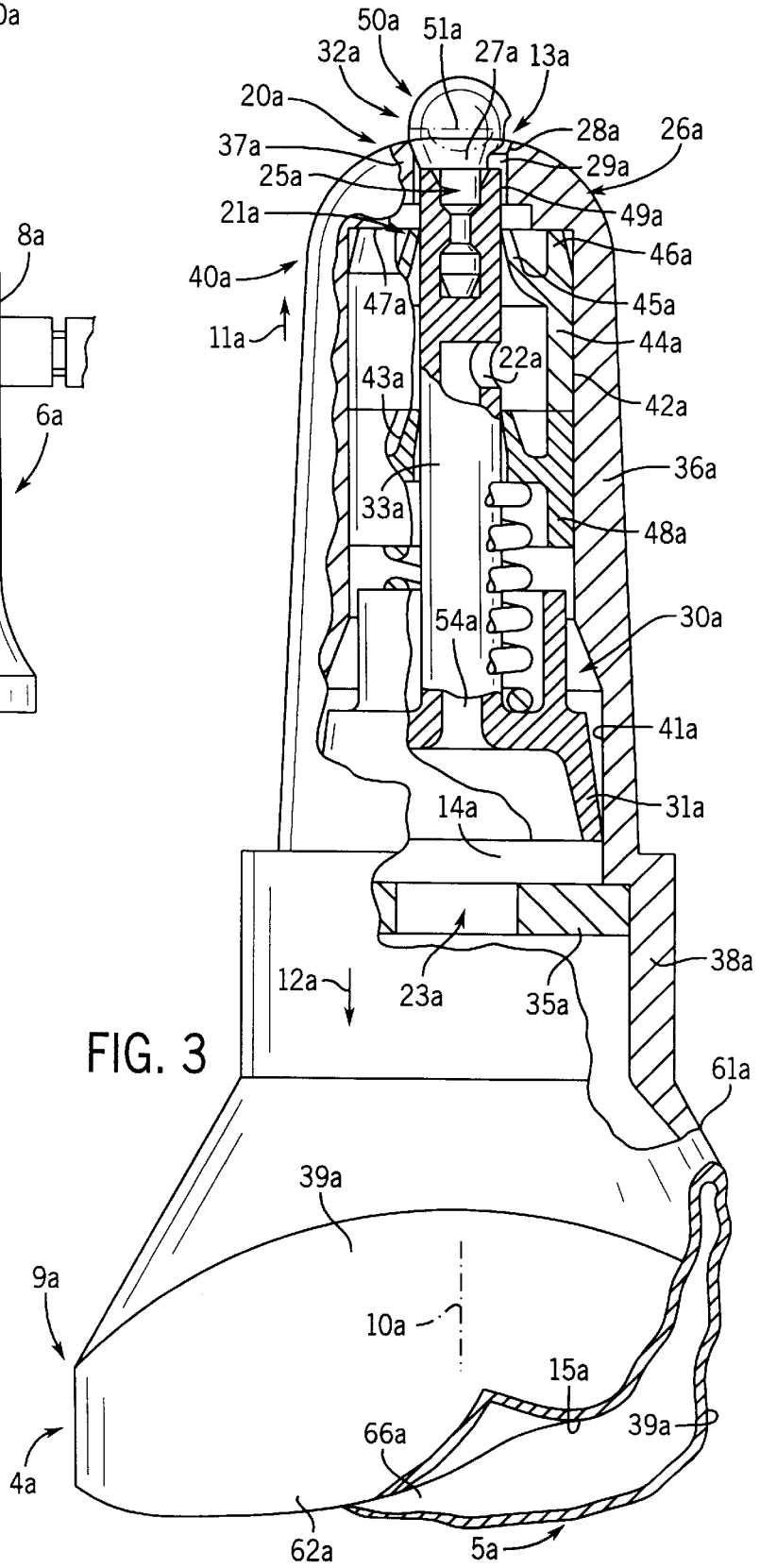
FIG. 3 is a partial axial section of an enlarged detail of FIG. 2.
Figure 4:
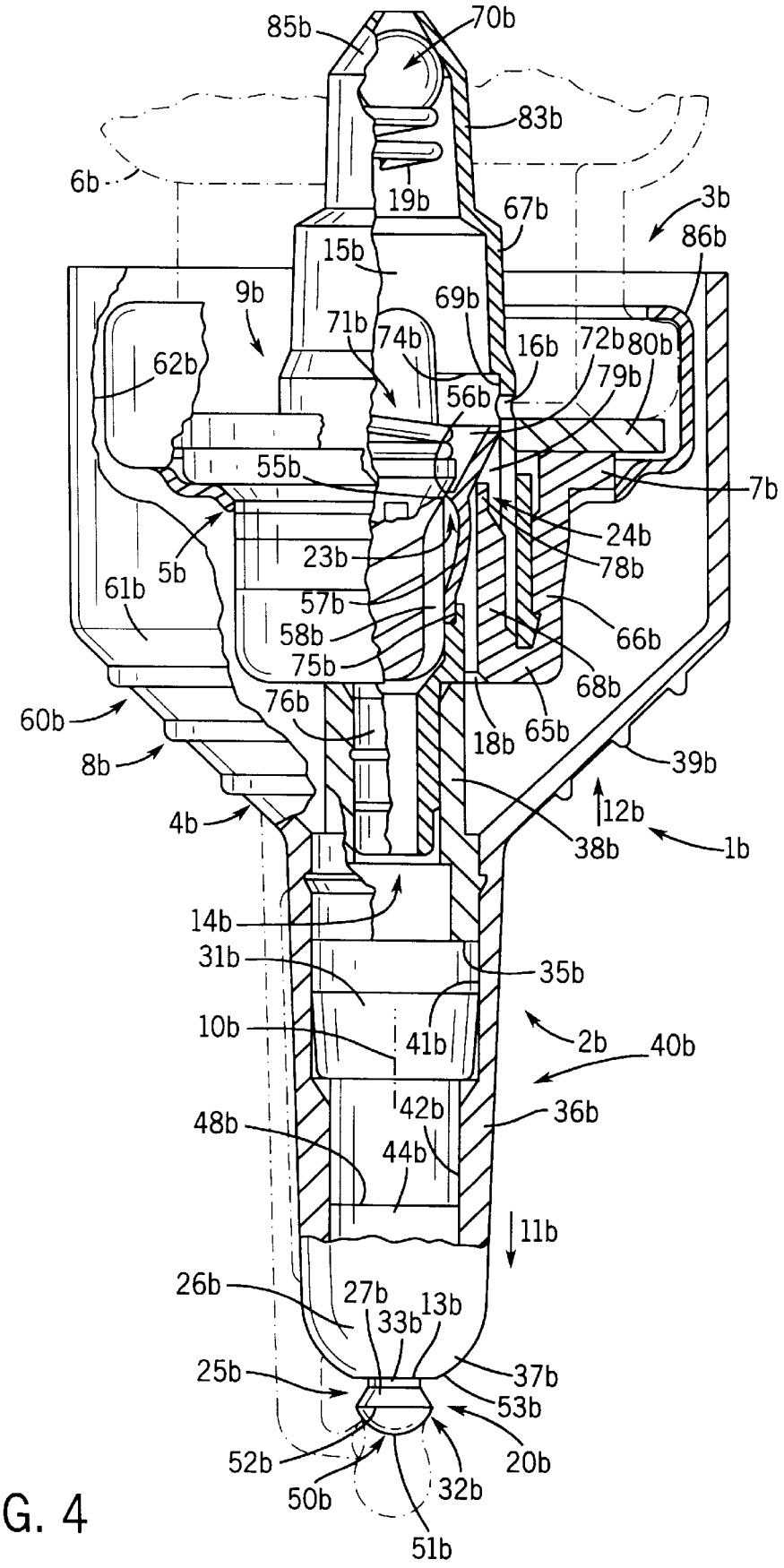
FIG. 4 illustrates still another dispenser with the valve open on commencement of the pump stroke and in the upside-down position.

Referring now to FIGS. 2 to 4 it will be appreciated that like parts have like reference numerals as shown in FIG. 1 but indexed differently, all passages of the description applying to all aspects and all features of all embodiments possibly being provided in addition and in combination, and thus all passages of the description applying accordingly to all embodiments.

Referring now to FIGS. 2 and 3 there is illustrated how the reservoir 6*a* and pump 9*a* of the dispenser la are formed by a flexible or resilient squeeze receptacle in the form of a tube elongated along the axis 10*a*. The bodies 4*a*, 5*a* are configured integral with each other. Outer sides facing away from each other of tube shell 62*a*, 66*a* integral circumferentially and full-length form the handles 39*a* for squeezing and shortening the reservoir volume. The head 40*a* including the walls 36*a*, 37*a*, 38*a* are configured integrally with the shell 62*a*, 66*a* and translate into the intermediate section 61a concically flared in the direction 12*a*. The end of the reservoir 6*a* remote from the orifice 13*a* and head 40*a* is initially cylindrically open. The control 30*a* or the parts 31a, 33*a*, 34*a*, 35*a*, 43*a*, 44*a* are accordingly introduced in the direction lla and brought into the function position in the body 26*a* either one after the other or as a preassembled unit. Then, the medium is filled through this opening into the reservoir 6*a*, after which this end is is squashed flat until opposing wall sections 62*a*, 66*a* are directly in contact with each other over a transverse strip as an endless band and are secured to each other by a bonding procedure, such as welding, to thus form a closure 7*a* for the reservoir space and the compression chamber 15*a*. The volume of the reservoir 6*a* is thus diminished with each metered discharge of medium as its medium volume. This may also be achieved by a climbing plunger which, instead of the closure 7*a* is included in the movement of the medium in the direction 11*a* slidingly sealed to the inner circumference of the reservoir 6*a*.

The plunger 31*a* forms with the stem 33*a* a preassembled or integral unit and is not in contact with the body 35*a* in the starting position. This body forms merely a constricted throttling element 23*a* for the valveless transition of the medium from the compression chamber 15*a* to the passage 14*a* . The stem 33*a* totally surrounds the passage 54*a* emerging between the seals 43*a*, 49*a* via a transverse passage 22 directly into a flared, annular mollification chamber surrounding it. This chamber has always the same volume. The lip 43*a* slides on the outer circumference of the stem 33*a*, this lip being formed together with the stop 48*a* by an annular or sleeve body separate from the bodies 31*a*, 33*a*, 44*a* and sealingly in contact over its full length also including the stop 48*a* with the surface area 42*a*, like the body 44*a*. The outer sleeve of the sealing body surrounds the lip 43*a* thereof with radial spacing, forms with one end the stop 48*a* and is in permanent contact by the other end with the outer sleeve of the body 44*a* on the face side. Like the lip 43*a* the lip 45*a* slides on the outer circumference of the stem 33*a* in its working movements. The lip 46*a* is conically tapered in the direction 11*a*. The head 32*a* translates at the more constricted end of the surface area 27*a* incrementally into a slimmer, finger-like appendage inserted as a fastening member into a blind hole of the stem 33*a* in the direction 12*a* and defined with zero axial clearance and preventing from twisting out of place by a snap action connector. The corresponding snap action members are configured integrally with the stem 33*a* and with the head 32*a*. The parts 33*a*, 32*a* adjoin each other flush by face surface areas the same in size. The bottom of the blind hole is located spaced away from the passage 54*a*. The spring 34*a* is directly supported by the body 43*a*, 48*a*, urging it against the body 44*a* as well as the latter against the stop 47*a*. The spring 34*a* is located in the dry space defined by the lips 31*a*, 43*a*. As indicated dot-dashed the end surface area 51*a* may also be curved concave or dished to reliably hold the droplet on an as small a base surface area as possible.

With the fingers of one hand the user of the dispenser 1*a* is able to produce a pressure of maximally 0.4 to 0.6 bar in the chamber 15*a* as a rule by squeezing the handles 39*a* radially oriented to the axis 10*a*. The effective surface area of the plunger 31 is selected correspondingly large to nevertheless overcome the counterforce of the spring 34*a* in opening the valve 20*a*. The counteracting plunger surface areas of the bodies 43*a*, 48*a* and 44*a* are correspondingly smaller. To increase the pressure in the chamber 15*a* a translation of the actuating force may also be provided which engages the surface areas 39*a* and forming therefor e.g. a lateral acting lever or a clamp or pincer. This lever may form radially spaced away from the reservoir 6*a* the handles of the discharge actuator 8*a* and comprise on the other side of the axis 10a a hinge, such as a flexing or spring hinge integrally joining the pincer levers for their mutal movement. The spring 34*a* is arranged in the dry space without coming into contact with the medium. The levers or other members may also join several dispensers 1*a* together through a set of design break points. The dispensers 1*a* located parallel juxtaposed may also be singled by parting the flush levers or straps.

Referring now to FIG. 4 there is illustrated the plunger unit 71*b* arranged on the unit 2*b* firmly seated seated with a plunger actuator. Secured to the actuator is an integral, flexible plunger sleeve, the downstream end of which forms the axially compressible spring 57*b* and the other end of which forms in the direction 12*b* the flared lip 72*b*. In between the plunger sleeve forms the annular valve element 56*b*, the seat of which 55*b* forms the actuator. The plunger sleeve is penetrated by the outlet passage and a core body comprising the passages 58*b* at the outer circumference. Secured to this body protruding in the direction 11*b* by a flared end 75*b* is a sleeve 76*b* locking the plunger sleeve in place. Secured to the sleeve 76*b* is a further sleeve 38*b*, the downstream end of which engages firmly seated the upstream end of the shell 36*b* via a snap-action lock. Both shells 38*b*, 36*b* are penetrated by the outlet passage 14*b* and define with the plunger 31*b* the mollification chamber. The shell 67*b* protrudes freely into the reservoir 6*b* and defines the chamber 15*b*, this shell comprising an inner shoulder 74*b* which stops the lip 72*b* at the end of the pumping stroke so that the valve 23*b* is opened in the subsequent travel of the stroke. Mounted on the end of the shell 67*b* in the direction 12*b* is an annular cover which may also be configured integral with the shell 67*b* or body 5*b*. The shell 66*b* of the cover snugly clasps the outer side, and the shell 68*b* the inner side of the shell 67*b*. The open end of the shell 67*b* is defined between the shells 65*b*, 66*b* by a snap-action lock. The flange 7*b* is configured integral with the cover. The end of the shell 68*b* forms the valve element 78*b* of the valve 24*b* and the conical outer side of the lip 72*b* the movable valve element thereof. The cover is penetrated by the plunger actuator, the plunger sleeve being permanently located therein over the majority of its length. The sleeve 38*b* may be configured integral with the sleeve 76*b* and form the stop 35*b*.

The valve 70*b* is located in the upstream end 85*b* of a constricted end section 83*b* of the shell 67*b* and is configured as a pressure relief valve having a valve ball corresponding to the valve 23. Its valve element is loaded by the spring 19*b* in the closed position, this spring being located in the chamber 15*b* and supported by the core body. The vent 18*b* is defined between the cover and the plunger sleeve. Downstream of the valve 23*b* the vent passes through the shell 67*b* outside of the chamber 15*b* so that air flows therefrom through the filter 80*c* into the reservoir 6*b*. The filter forms at the same time the reservoir seal directly in sealing contact with the flange 7*b* and with the shell 67*b*.

An inlet 16*b* from the reservoir 6*b* to the chamber 15*b* may also pass through the wall 67*b* directly adjacent to the seal 80*b*. The definition of the inlet 16*b* forms with the lip 72*b* an inlet valve or slide valve which is closed after a first portion of the stroke travel and is reopened towards the end of the return stroke, thus enabling the reservoir 6*b* to be totally emptied. This valve as well as the valve 70*b* are configured without a riser conduit 17 so that priming the medium is only possible in the upside-down position. The shell 67*b* could also be sealingly closed at the upstream end instead of an inlet opening.

The wall 61*b* is conically flared at right angles in the direction 12*b* and directly slidingly adjoins the outer circumferences of the shells 36*b*, 62*b*. The handle 39*b* comprises protuberances or coaxial annular cams to prevent the fingers slipping out of place. The shells 61*b*, 62*b* permanently surround the body 5*b* over the majority of its length so that only the end 83*b* protrudes. For securing the body 5*b* a crimp ring 86*b* is provided within the shell 62*b*, this crimp ring contacting the flange 7*b* and a corresponding flange of the reservoir neck by the face side in each case and accommodating in the interior the seal 80*b*.

Indicated evident in FIG. 4 is the suspended 20 $\mu$l droplet, the volume of which is maximally three or two times or just as large as the volume of the head 32*b*. In FIG. 4 the valve 20*b* is shown open and the plunger 72*b* is in the starting position at the start of the pumping stroke. FIG. 4 also indicates dot-dashed a protective cap for the head 40*b*, this protective cap being in close or sealing contact with the outer sides of the walls 36*b*, 37*b*, 61*b* and is to be removed from the dispenser 1*b* in the direction 11*b*. At the face wall the cap comprises a protuberance which presses linearly pointwise or annularly against the surface area 51*b* of the body 25*b* in its closed position, whereas all other portions of the surface area 51*b* are without contact, as a result of which, however, the closing pressure between the closing surface areas of the valve 20*b* is enhanced during the shelf life of the dispenser.

The dispenser 1*a* may be composed of maximally six or only four injection molded plastics parts as well as the spring 34*a*. For instance, the parts 43*a*, 44*a*, 48*a* or the parts 35*a*, 36*a*, 38*a* may be configured integral with each other. Without the reservoir 6 the dispenser 1 may consist of seven or eight such injection molded parts to which three springs 19, 34, 57, the body 56, the filter 80 and, where necessary, the riser tube 17 are added. The bodies 5, 7, 82, the bodies 31, 44 and the bodies 4, 35 could be likewise configured integral. Each of the springs could also be configured integrally of a plastics material with one or both of the components by which they are directly supported. All cited features and properties may be provided precisely as described, or merely substantially or approximately so and may also greatly deviate therefrom depending e.g. on the viscosity of the medium. The size relationships as described are particularly favorable, more particularly when the length of the dispenser 1 as measured over the bodies 4, 5, 40 is smaller than 10 cm or 7 cm and its largest bore, smaller as compared thereto, is smaller than 5 cm or 3 cm.

What is claimed is:

1. A dispenser for discharging a medium under pressure, comprising:

a base body (4, 4*a*, 5*a*);

a conveying chamber (15, 15*a*) disposed in the base body (4, 4*a*, 5*a*) for containing the medium under pressure, said conveying chamber (15, 15*a*) having an outlet passageway (55, 23*a*);

a discharge actuator (8, 8*a*) that is operable for initiating flow of the medium out of the conveying chamber;

an outlet duct (14, 14*a*) in communication with the outlet passageway (55, 23*a*) for receiving the medium from the conveying chamber (15,15*a*) and ending in a medium outlet (13, 13*a*), said outlet duct (14, 14*a*) determining a flow direction, and a valve (20, 20*a*) closing said outlet duct (14, 14*a*), said valve having closing faces (27, 28, 27*a*, 28*a*) including a valve seat (28, 28*a*), said valve (20, 20*a*) including first and second valve bodies (25, 26; 25*a*, 26*a*), said valve including means for applying a stress (34, 34*a*) to hold said first valve body (25,25*a*) in a closed position, said first valve body (25,25*a*) being lifted off said valve seat (28, 28*a*) in response to movement of the fluid under pressure and counter to a closing stress, wherein when opening said valve, said first valve body (25, 25*a*) moves substantially in a same direction as said flow direction (11, 11*a*).

2. The dispenser according to claim 1, wherein said dispenser (1, 1*a*) includes said first valve body and another portion of said dispenser which together define external faces which are operationally freely accessible, said first valve body including a projection jutting over said external faces, said valve body (25, 25*a*) traversing said valve seat (28, 28*a*).

3. The dispenser according to claim 1, wherein said outlet duct (14, 14*a*) connects upstream to said output passageway (55, 23*a*), said conveying chamber being a pressure chamber (15, 15*a*), and outlet closure (23) being included and closing said output passageway (55, 23*a*), and said dispenser further comprising control means (30) for opening said outlet closure and thereafter open said valve (20, 20*a*).

4. The dispenser according to claim 3, wherein said valve (20, 20*a* ) opens at a lower pressure than said outlet closure (23, 23*a*).

5. The dispenser according to claim 1, wherein said valve seat (28, 28*a*) is substantially stationary relative to said base body (4, 4*a*, 5*a*), said first valve body (25, 25*a*) being unseatable from said valve seat in said flow direction (11, 11*a*) and towards said medium outlet (13, 13*a*).

6. The dispenser according to claim 1, wherein said first valve body (25, 25*a*) includes a seating face (27, 27*a*) contacting said valve seat (28, 28*a*), said valve seat being conical.

7. The dispenser according to claim 1, further comprising a control piston (31, 31*a*) which bounds a volumetrically variable control chamber (14) and wherein said valve (20, 20*a*) is driven by said control piston.

8. The dispenser according to claim 1, wherein said second valve body (26) is a component separate from and protruding beyond said base body (4).

9. The dispenser according to claim 1, wherein said second valve body (26, 26*a*) includes a housing (40, 40*a*) which encapsulates a control piston (31, 31*a*).

10. The dispenser according to claim 1 and further including a throttle (21, 22, 23; 21*a*, 22*a*, 23*a*) which defines a smallest passage cross-section of said outlet duct (14, 14*a*), wherein said throttle (21, 22, 23; 21*a*, 22*a*, 23*a*) is located upstream and spaced from said valve seat (28, 28*a*).

11. The dispenser according to claim 10, wherein said smallest passage cross-section is resiliently variable.

12. The dispenser according to claim 10, further including a control body (31, 31*a*) operationally displaceable substantially parallel to said first valve body (25, 25*a*), wherein said throttle (21, 22; 21*a*,22*a* ) is located between said control body (31, 31*a*) and said valve seat.

13. The dispenser according to claim 1, wherein for assembling said first valve body (25, 25*a*) is inserted in said valve seat (28, 28*a*) counter said flow direction (11, 11*a*).

14. The dispenser according to claim 1, further including a discharge head (40) separate from said base body (4), wherein said discharge head (40) projecting inside and said discharge head in said flow direction (11), said base body (4) enveloping a duct closure (23) variably constricting said outlet duct (14).

15. The dispenser according to claim 1, wherein said valve seat (28, 28*a*) is operationally rigid.

16. The dispenser according to claim 1, further including a first chamber body (64, 62*a*) and a second chamber body (71, 66*a*) displaceable with respect to said first chamber body and bounding said conveying chamber (64, 62*a*), wherein said first chamber body and said second chamber body constrict said conveying chamber (15, 15*a*) while pressurizing the medium toward said medium outlet (13, 13*a*).

17. The dispenser according to claim 16, wherein said first chamber body (64) is a pump cylinder and said second chamber body (71) is a pump piston.

18. The dispenser according to claim 17, wherein said pump cylinder (64) is unitary with said base body (4) and said valve seat (28).

19. The dispenser according to claim 16, wherein said conveying chamber (15*a*) is bounded by a squeeze container including chamber walls (62*a*, 66*a*), said chamber walls.

20. The dispenser according to claim 19, wherein said valve seat (28*a*) and said chamber bodies (62*a*, 66*a*) are made in one part, said conveying chamber being a reservoir (6*a*) for storing the medium, said reservoir being internal volumerically larger than said outlet duct (14*a*) which holds the medium independent from a direction in which said dispenser is oriented.

21. The dispenser according to claim 1, further including a connector (86, 86*b*) for connecting said dispenser (1, 1*b*) to a reservoir (6, 6*b*) for the medium, wherein said valve seat (28) is operationally displaceable relative to said connector (86, 86*b*) for at least one of pressurizing the medium, and displacing said first valve member (25, 25*b*)

relative to said valve seat (28).

22. The dispenser according to claim 1, further including venting means (18, 18*b*) for venting a reservoir (6, 6*b*), wherein said venting means (18, 18*b*) include a venting duct (79, 81) traversing said dispenser (1) and bypassing said medium outlet (13, 13*a*).

23. The dispenser according to claim 22, wherein said venting means (18, 18*b*) include germicidal means (80, 80*b*).

24. The dispenser according to claim 22, wherein said venting duct (79, 81) includes a closure (24, 24*b*) which is openable.

25. The dispenser according to claim 1, further including a sealing flange (7) for sealingly connecting said dispenser (1) to a reservoir (6) for the medium, wherein a connector (86) is included for connecting said dispenser (1) to the reservoir (6), said sealing flange (7) being a component separate from said connector (36) and including a riser duct (17, 85) for the medium.

26. The dispenser according to claim 1, further including a reservoir (6*a*) for the medium, wherein said reservoir (6*a*) includes an entrance (7*a*) which is closeable, a control member (31*a*) being included and operating said valve (20*a*), said control member (31*a*) being assembled by being inserted through said entrance in said reservoir (6*a*).

27. The dispenser according to claim 1, further including a reservoir (6*a*) for the medium, wherein said reservoir (6*a*) includes a closeable entrance (7*a*) at an end remote from said medium outlet (13*a*), the medium being filled into said reservoir (6*a*) through said closeable entrance (7*a*).

28. The dispenser according to claim 1, further including a drop former (50, 50*a*) for presenting the medium in drop clusters, wherein means are included for adhering said drop clusters individually only to said drop former (50, 50*a*) which is a unitary component.

29. The dispenser according to claim 28, wherein said drop former (50, 50*a*) includes mutually remote end faces (27, 51) and a substantially annular edge (52) between said mutually remote end faces (27, 51).

30. A dispenser for discharging media comprising:

a base body (4; 4*a*, 5*a*);

a discharge actuator (8, 8*a*);

an outlet duct (14, 14*a*) supplied with the medium from an output (55, 23*a*) of a conveying chamber (15, 15*a*) and ending in a medium outlet (13, 13*a*), said outlet duct determining a flow direction (11, 11*a*);

means for supplying a fluid under pressure;

a valve (20, 20*a*) closing said outlet duct (14, 14*a*) at closing faces (27, 28, 27*a*, 28*a*) including a valve seat (28, 28*a*), said valve (20, 20*a*) including first and second valve bodies (25, 26; 25*a*, 26*a*), and means for generating a closing stress, said first valve body (25, 25*a*) operationally assuming valve positions including a closed position and when in said closed position said first valve body (25, 25*a*) lifting off said valve seat (28, 28*a*) by being driven from the fluid under pressure counter to said closing stress (34, 34*a*), wherein for assembling said first valve body (25, 25*a*), said first valve body (25, 25*a*) is inserted through said base body (4, 4*a*) toward said valve seat (28, 28*a*) counter said flow direction (11, 11*a*), said second valve body (26, 26*a*) including said valve seat (28, 28*a*), said valve seat (28, 28*a*) enveloping said first valve body (25, 25*a*), said base body (4; 4*a*, 5*a*) being traversed by said outlet duct (14, 14*a*) and said medium outlet (13, 13*a*).

31. A dispenser for discharging media comprising:

a base body (4; 4*a*, 5*a*);

a discharge actuator (8, 8*a*);

an outlet duct (14, 14*a*) supplied with the medium from an output (55, 23*a*) of a conveying chamber (15, 15*a*) and ending in a medium outlet (13, 13*a*), said outlet duct determining a flow direction (11, 11*a*);

means for supplying a fluid under pressure;

a valve (20, 20*a*) closing said outlet duct (14, 14*a*) at closing faces (27, 28, 27*a*, 28*a*) including a valve seat (28, 28*a*), said valve (20, 20*a*) including first and second valve bodies (25, 26; 25*a*, 26*a*), and means for generating a closing stress, said first valve body (25, 25*a*) operationally assuming valve positions including a closed position and when in said closed position said first valve body (25, 25*a*) lifting off said valve seat (28, 28*a*) by being driven from the fluid under pressure counter to said closing stress (34, 34*a*), wherein said dispenser (1, 1*a*) includes a first chamber body (62*a*) and a second chamber body (66*a*) displaceable with respect to said first chamber body and bounding said conveying chamber (15*a*) commonly with said first chamber body (62*a*), said first chamber body (62*a*) and said second chamber body (66*a*) constricting said conveying chamber (15*a*) while pressurizing the medium toward said medium outlet (13*a*), said conveying chamber (15*a*) being bounded by a squeeze container including chamber walls (62*a*, 66*a*), said chamber walls including said chamber bodies, said first valve body (25*a*) directly connecting to a valve stem (33*a*) slidingly displaceable within said base body (4*a*, 5*a*) and circumferentially entirely bounding said outlet duct (14*a*).

32. The dispenser according to claim 31, wherein said valve seat (28*a*) and said chamber bodies (62*a*, 66*a*) are commonly made in one part, said conveying chamber being a reservoir (6*a*) for storing the medium, said reservoir being internally volumetrically larger than said outlet duct (14*a*) which holds the medium independent from how said dispenser is oriented, said reservoir (6*a*) being closed with a reservoir bottom located remote from said medium outlet (13*a*) and directly connecting to said chamber bodies (62*a*, 66*a*).

33. A dispenser for discharging media comprising:

a base body (4; 4*a*, 5*a*);

a discharge actuator (8, 8*a*);

an outlet duct (14, 14*a*) supplied with the medium from an output (55, 23*a*) of a conveying chamber (15, 15*a*) and ending in a medium outlet (13, 13*a*), said outlet duct determining a flow direction (11, 11*a*);

means for supplying a fluid under pressure;

a valve (20, 20*a*) closing said outlet duct (14, 14*a*) at closing faces (27, 28, 27*a*, 28*a*) including a valve seat (28, 28*a* ), said valve (20, 20*a*) including valve bodies, namely first and second valve bodies (25, 26; 25*a*, 26*a*), and means for generating a closing stress, said first valve body (25, 25*a*) operationally assuming valve positions including a closed position and when in said closed position said first valve body (25, 25*a*) lifting off said valve seat (28, 28*a*) by being driven from the fluid under pressure counter to said closing stress (34, 34*a*), wherein said dispenser (1*a*) includes a reservoir (6*a*) for the medium, said reservoir (6*a*) including a bottom end facing away from said medium outlet (13*a*), said bottom end bounding an entrance (7*a*) which is closeable, a control member (31*a*) being included and operating said valve (20*a*), said control member (31*a*) being assembled by being inserted through said entrance and said reservoir (6*a*).

34. A dispenser for discharging media comprising:

a base body (4; 4*a*, 5*a*);

a discharge actuator (8, 8*a*);

an outlet duct (14, 14*a*) supplied with the medium from an output (55, 23*a*) of a conveying chamber (15, 15*a*) and ending in a medium outlet (13, 13*a*), said outlet duct determining a flow direction (11, 11*a*);

means for supplying a fluid under pressure;

a valve (20, 20*a*) closing said outlet duct (14, 14*a*) at closing faces (27, 28, 27*a*, 28*a*) including a valve seat (28, 28*a*), said valve (20, 20*a*) including valve bodies, namely first and second valve bodies (25, 26; 25*a*, 26*a*), and means for generating a closing stress, said first valve body (25, 25*a*) operationally assuming valve positions including a closed position and when in said closed position said first valve body (25, 25*a*) lifting off said valve seat (28, 28*a*) by being driven from the fluid under pressure counter to said closing stress (34, 34*a*), wherein said dispenser (1*a*) includes a reservoir (6*a*) for the medium, said reservoir (6*a*) including a closeable entrance (7*a*) at an end facing away from said medium outlet (13*a*), the medium being filled into said reservoir (6*a*) through said closeable entrance (7*a*), said closeable entrance (7*a*) and said medium outlet (13*a*) being commonly bounded in one part, after closing said closeable entrance being squashed flat.

35. A dispenser for discharging media comprising:

a base body (4; 4*a*, 5*a*);

a discharge actuator (8, 8*a*);

an outlet duct (14, 14*a*) supplied with the medium from an output (55, 23*a*) of a conveying chamber (15, 15*a*) and ending in a medium outlet (13, 13*a*), said outlet duct determining a flow direction (11, 11*a*);

means for supplying a fluid under pressure;

a valve (20, 20*a*) closing said outlet duct (14, 14*a*) at closing faces (27, 28, 27*a*, 28*a*) including a valve seat (28, 28*a*), said valve (20, 20*a*) including valve bodies, namely first and second valve bodies (25, 26; 25*a*, 26*a*), and means for generating a closing stress, said first valve body (25, 25*a*) operationally assuming valve positions including a closed position and when in said closed position said first valve body (25, 25*a*) lifting off said valve seat (28, 28*a*) by being driven from the fluid under pressure counter to said closing stress (34, 34*a*), wherein said dispenser (1, 1*a*) includes a drop former (50, 50*a*) for presenting the medium in drop clusters, means being included for adhering said drop clusters individually only to said drop former (50, 50*a* ) which is a unitary component separate from said base body (4; 4*a*, 5*a*), said base body bounding said medium outlet (13, 13*a*).

36. A dispenser for discharging media comprising:

a base body (4; 4*a*, 5*a*);

a discharge actuator (8, 8*a*);

an outlet duct (14, 14*a*) supplied with the medium from an output (55, 23*a*) of a conveying chamber (15, 15*a*) and ending in a medium outlet (13, 13*a*), said outlet duct determining a flow direction (11, 11*a*);

means for supplying a fluid under pressure;

a valve (20, 20*a*) closing said outlet duct (14, 14*a*) at closing faces (27, 28, 27*a*, 28*a*) including a valve seat (28, 28*a*), said valve (20, 20*a*) including valve bodies, namely first and second valve bodies (25, 26; 25*a*, 26*a*), and means for generating a closing stress, said first valve body (25, 25*a*) operationally assuming valve positions including a closed position and when in said closed position said first valve body (25, 25*a*) lifting off said valve seat (28, 28*a*) by being driven from the fluid under pressure counter to said closing stress (34, 34*a*), wherein said dispenser (1, 1*a*) includes a drop former (50, 50*a*) for presenting the medium in drop clusters, said drop former (50, 50*a*) including mutually remote end faces (27, 51) and a substantially annular edge (52) between said mutually remote end faces (27, 51).

* * * * *